US009912071B2

(12) United States Patent
Diukman et al.

(10) Patent No.: US 9,912,071 B2
(45) Date of Patent: Mar. 6, 2018

(54) QUASI-YAGI-TYPE ANTENNA

(71) Applicant: QUALCOMM Incorporated, San Diego, CA (US)

(72) Inventors: Iddo Diukman, Haifa (IL); Alon Yehezkely, Haifa (IL)

(73) Assignee: QUALCOMM Incorporated, San Diego, CA (US)

( * ) Notice: Subject to any disclaimer, the term of this patent is extended or adjusted under 35 U.S.C. 154(b) by 119 days.

(21) Appl. No.: 14/561,680

(22) Filed: Dec. 5, 2014

(65) Prior Publication Data

US 2015/0194736 A1 Jul. 9, 2015

Related U.S. Application Data

(60) Provisional application No. 61/925,011, filed on Jan. 8, 2014.

(51) Int. Cl.

| | |
|---|---|
| ***H01Q 13/18*** | (2006.01) |
| ***H01Q 19/30*** | (2006.01) |
| ***H01Q 1/50*** | (2006.01) |
| ***H01Q 1/48*** | (2006.01) |
| ***H01Q 9/20*** | (2006.01) |
| ***H01Q 21/00*** | (2006.01) |
| ***H01Q 21/06*** | (2006.01) |

(52) U.S. Cl.

CPC ..... *H01Q 19/30* (2013.01); *H01Q 1/48* (2013.01); *H01Q 1/50* (2013.01); *H01Q 9/20* (2013.01); *H01Q 21/0006* (2013.01); *H01Q 21/062* (2013.01)

(58) Field of Classification Search

CPC ..... H01Q 19/30; H01Q 1/50; H01Q 1/48; H01Q 21/0006; H01Q 21/062

USPC ..... 343/818, 820, 821

See application file for complete search history.

(56) References Cited

U.S. PATENT DOCUMENTS

| | | | | |
|---|---|---|---|---|
| 5,274,391 | A | 12/1993 | Connolly | |
| 5,532,708 | A * | 7/1996 | Krenz | H01Q 9/40 343/795 |
| 6,114,997 | A * | 9/2000 | Lee | H01Q 1/38 343/700 MS |
| 6,476,773 | B2 | 11/2002 | Palmer et al. | |
| 8,174,336 | B2 | 5/2012 | Kim et al. | |
| 8,269,672 | B2 | 9/2012 | Tinaphong et al. | |
| 9,570,809 | B2 | 2/2017 | Ganchrow et al. | |
| 2008/0158081 | A1 * | 7/2008 | Rofougaran | H01L 23/66 343/787 |
| 2009/0295667 | A1 | 12/2009 | Ma et al. | |

(Continued)

FOREIGN PATENT DOCUMENTS

| | | | |
|---|---|---|---|
| DE | 2020192 | A1 | 11/1971 |
| EP | 2575213 | A1 | 4/2013 |
| GB | 765465 | A | 1/1957 |

OTHER PUBLICATIONS

International Search Report and Written Opinion—PCT/US2014/069105—ISA/EPO—Mar. 11, 2015, 11 pages.

*Primary Examiner* — Dameon E Levi

*Assistant Examiner* — David Lotter

(74) *Attorney, Agent, or Firm* — Qualcomm Incorporated-Toler

(57) ABSTRACT

An apparatus includes a first ground plane, a second ground plane, an antenna, and a balun coupled to the antenna. The balun is disposed between the first ground plane and the second ground plane.

20 Claims, 6 Drawing Sheets

(56) References Cited

U.S. PATENT DOCUMENTS

| | | | | |
|---|---|---|---|---|
| 2010/0033395 | A1* | 2/2010 | Ding | H01Q 1/2283 343/834 |
| 2011/0037678 | A1* | 2/2011 | Tang | H01Q 1/2266 343/860 |
| 2011/0285474 | A1* | 11/2011 | Ali | H01P 5/10 333/33 |
| 2012/0218156 | A1 | 8/2012 | Mohammadian | |
| 2013/0082893 | A1* | 4/2013 | Wang | H01Q 9/065 343/810 |
| 2014/0055208 | A1* | 2/2014 | Kondo | H01P 7/10 333/12 |
| 2014/0287702 | A1* | 9/2014 | Schuppener | H01P 3/16 455/90.2 |
| 2014/0292604 | A1* | 10/2014 | Kaneda | H01Q 19/30 343/772 |
| 2014/0361946 | A1 | 12/2014 | Ganchrow et al. | |
| 2015/0070228 | A1* | 3/2015 | Gu | H01Q 1/2283 343/727 |
| 2017/0117635 | A1 | 4/2017 | Ganchrow et al. | |

* cited by examiner

QUASI-YAGI-TYPE ANTENNA

I. CROSS-REFERENCE TO RELATED APPLICATIONS

The present application claims priority from U.S. Provisional Patent Application No. 61/925,011, filed Jan. 8, 2014 and entitled "QUASI YAGI STRIPLINE ANTENNA," the content of which is incorporated by reference in its entirety.

II. FIELD

The present disclosure is generally related to antennas.

III. DESCRIPTION OF RELATED ART

Advances in technology have resulted in smaller and more powerful computing devices. For example, there currently exist a variety of portable personal computing devices, including wireless computing devices, such as portable wireless telephones, personal digital assistants (PDAs), and paging devices that are small, lightweight, and easily carried by users. More specifically, portable wireless telephones, such as cellular telephones and Internet protocol (IP) telephones, can communicate voice and data packets over wireless networks. Further, many such wireless telephones include other types of devices that are incorporated therein. For example, a wireless telephone can also include a digital still camera, a digital video camera, a digital recorder, and an audio file player. Also, such wireless telephones can process executable instructions, including software applications, such as a web browser application, that can be used to access the Internet. As such, these wireless telephones can include significant computing capabilities.

For wireless systems, such as 60 gigahertz (GHz) wireless systems, it is desirable to include multiple antennas in a single device to increase transmission and reception capabilities of the device. With the reduction in size of a system in package (SiP) that includes a radio frequency integrated circuit within a mobile communication device, it has become difficult to place a large numbers of antennas in the SiP. One past approach to increase the number of antennas is to use antennas positioned on a ground plane on a surface of a printed circuit (PC) board, but the number of such antennas that can be included is limited by the available surface area of the PC board.

IV. BRIEF DESCRIPTION OF THE DRAWINGS

V. DETAILED DESCRIPTION

The detailed description set forth below is intended as a description of exemplary designs of the present disclosure and is not intended to represent the only designs in which the present disclosure can be practiced. The term "exemplary" is used herein to mean "serving as an example, instance, or illustration." Any design described herein as "exemplary" is not necessarily to be construed as preferred or advantageous over other designs. The detailed description includes specific details for the purpose of providing a thorough understanding of the exemplary designs of the present disclosure. It will be apparent to those skilled in the art that the exemplary designs described herein may be practiced without these specific details. In some instances, well-known structures and devices are shown in block diagram form in order to avoid obscuring the novelty of the exemplary designs presented herein.

Figure 1:
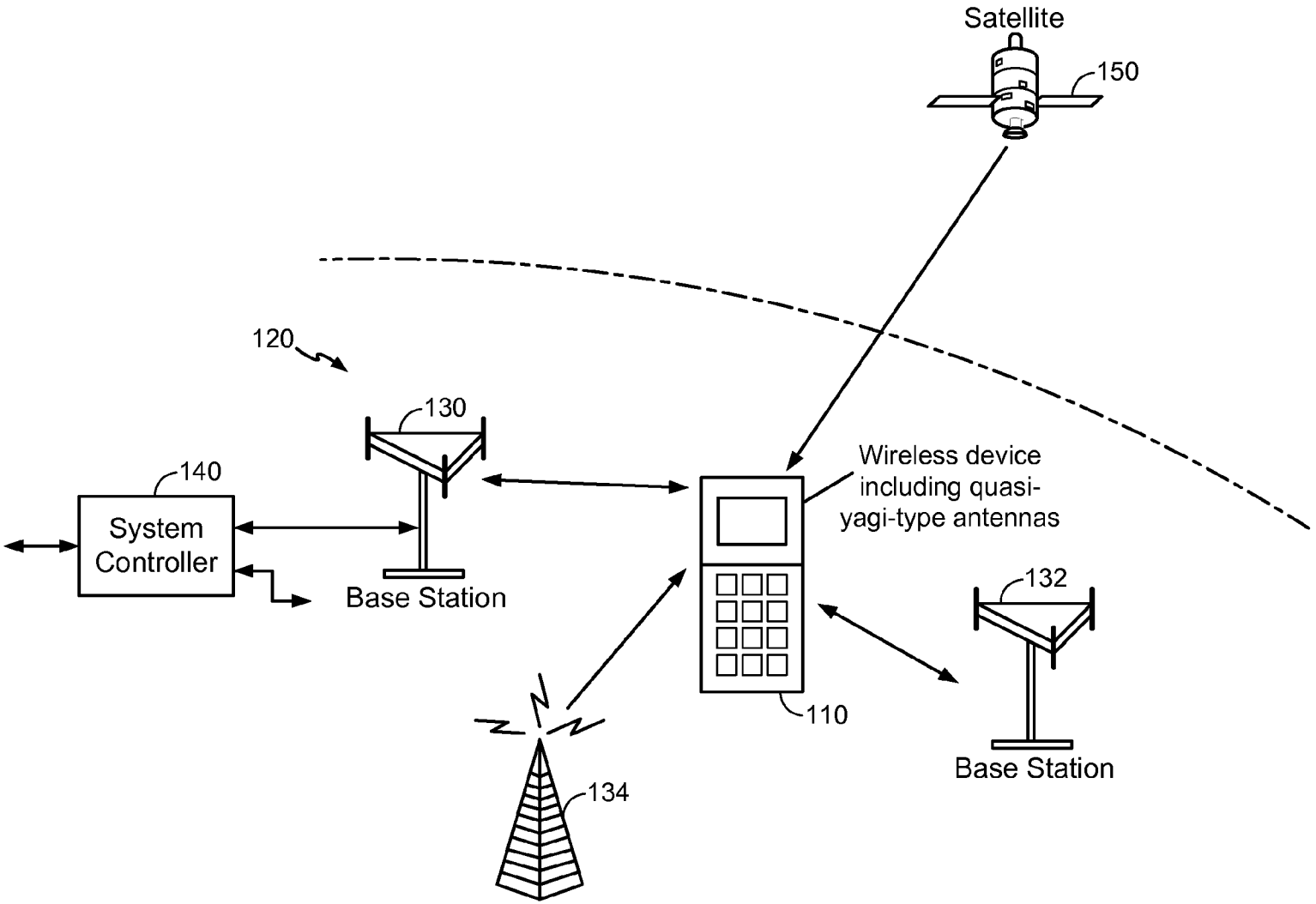
FIG. 1 shows a wireless device that includes a quasi-yagi-type antenna.

FIG. 1 shows a wireless device 110 communicating with a wireless communication system 120. Wireless communication system 120 may be a Long Term Evolution (LTE) system, a Code Division Multiple Access (CDMA) system, a Global System for Mobile Communications (GSM) system, a wireless local area network (WLAN) system, a wireless system operating in accordance with one or more Institute of Electrical and Electronics Engineers (IEEE) protocols or standards (e.g., IEEE 802.11ad), a 60 GHz wireless system, a millimeter wave (mm-wave) wireless system, or some other wireless system. A CDMA system may implement Wideband CDMA (WCDMA), CDMA 1×, Evolution-Data Optimized (EVDO), Time Division Synchronous CDMA (TD-SCDMA), or some other version of CDMA. For simplicity, FIG. 1 shows wireless communication system 120 including two base stations 130 and 132 and one system controller 140. In general, a wireless system may include any number of base stations and any set of network entities.

Wireless device 110 may also be referred to as user equipment (UE), a mobile station, a terminal, an access terminal, a subscriber unit, a station, etc. Wireless device 110 may be a cellular phone, a smartphone, a tablet, a wireless modem, a personal digital assistant (PDA), a handheld device, a laptop computer, a smartbook, a netbook, a cordless phone, a wireless local loop (WLL) station, a Bluetooth device, etc. Wireless device 110 may communicate with wireless communication system 120. Wireless device 110 may also receive signals from broadcast stations (e.g., a broadcast station 134), signals from satellites (e.g., a satellite 150) in one or more global navigation satellite systems (GNSS), etc. Wireless device 110 may support one or more radio technologies for wireless communication such as LTE, WCDMA, CDMA 1×, EVDO, TD-SCDMA, GSM, IEEE 802.11ad, wireless gigabit, 60 GHz frequency band communication, mm-wave communication, etc.

Furthermore, in an exemplary embodiment, the wireless device 110 may include one or more quasi-yagi-type antennas (e.g., as part of one or more antenna arrays), as further described herein. In a particular example, a quasi-yagi-type antenna may be an antenna having a balun between two ground planes and having a dipole extending from an edge of a printed circuit board (PC). Vias may be coupled between the ground planes to create a via "wall" at or near the edge that functions as a reflector. Illustrative quasi-yagi-type antenna(s) are further described with reference to FIGS. 3-5.

Figure 2:
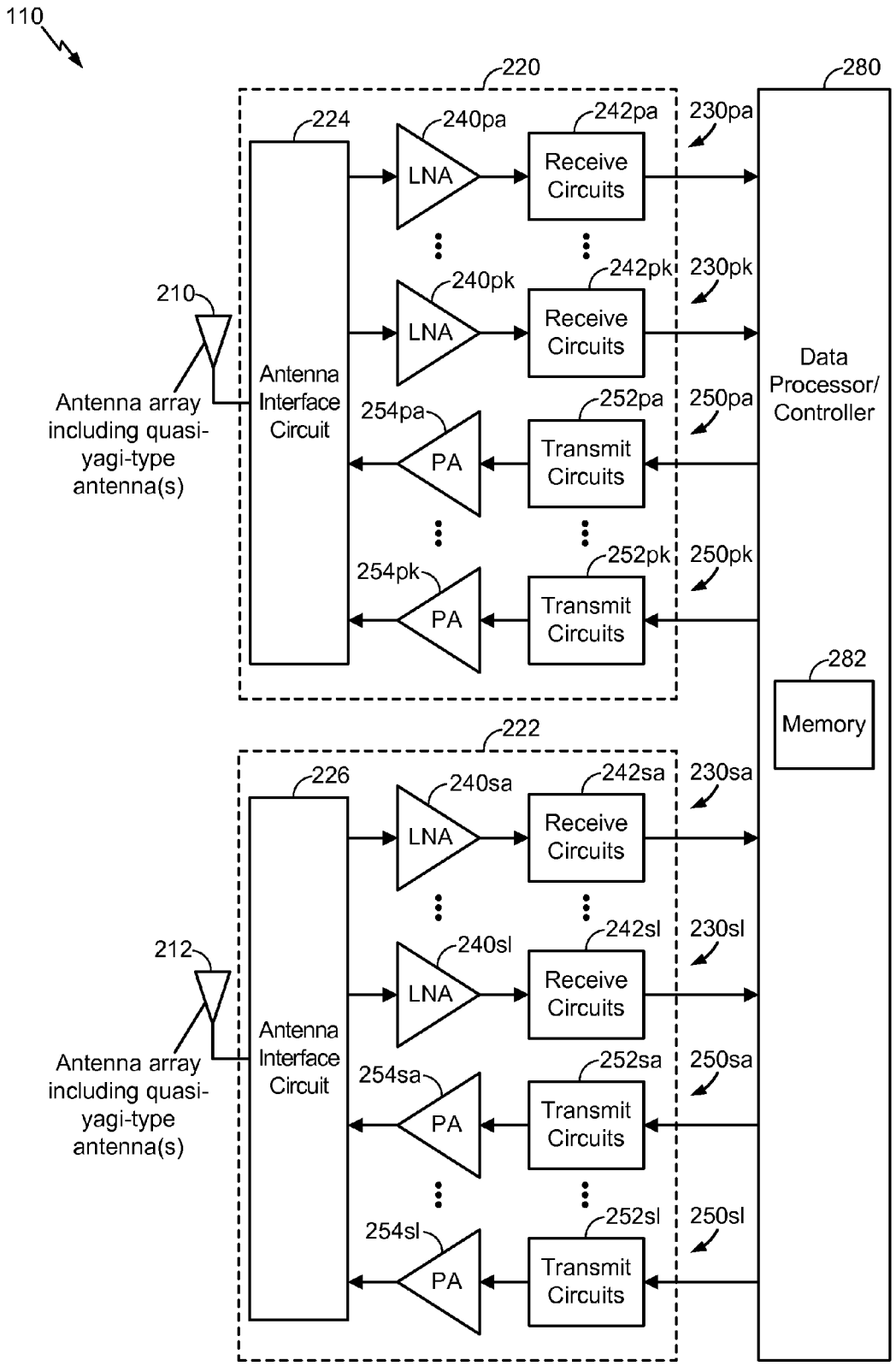
FIG. 2 shows a block diagram of components of the wireless device in FIG. 1.

FIG. 2 shows a block diagram of an exemplary design of components of the wireless device 110. In this exemplary design, the wireless device 110 includes a transceiver 220 coupled to a primary antenna array 210, a transceiver 222 coupled to a secondary antenna array 212, and a data processor/controller 280. Transceiver 220 includes multiple (K) receivers 230*pa* to 230*pk* and multiple (K) transmitters 250*pa* to 250*pk* to support multiple frequency bands, multiple radio technologies, carrier aggregation, etc. Transceiver 222 includes multiple (L) receivers 230*sa* to 230*sl* and multiple (L) transmitters 250*sa* to 250*sl* to support multiple frequency bands, multiple radio technologies, carrier aggregation, receive diversity, multiple-input multiple-output (MIMO) transmission from multiple transmit antennas to multiple receive antennas, etc.

The primary antenna array 210 and/or the secondary antenna array 212 may include one or more quasi-yagi-type antennas, as further described with reference to FIGS. 3-5. In addition, the primary antenna array 210 and/or the secondary antenna array 212 may include one or more other antenna types, such as patch antennas, as further described with reference to FIG. 4.

In the exemplary design shown in FIG. 2, each receiver 230 includes an LNA 240 and receive circuits 242. For data reception, the primary antenna array 210 receives signals from base stations and/or other transmitter stations and provides a received RF signal, which is routed through an antenna interface circuit 224 and presented as an input RF signal to a selected receiver. Antenna interface circuit 224 may include switches, duplexers, transmit filters, receive filters, matching circuits, etc. The description below assumes that receiver 230*pa* is the selected receiver. Within receiver 230*pa*, an LNA 240*pa* amplifies the input RF signal and provides an output RF signal. Receive circuits 242*pa* downconvert the output RF signal from RF to baseband, amplify and filter the downconverted signal, and provide an analog input signal to data processor/controller 280. Receive circuits 242*pa* may include mixers, filters, amplifiers, matching circuits, an oscillator, a local oscillator (LO) generator, a phase locked loop (PLL), etc. Each remaining receiver 230 in transceivers 220 and 222 may operate in a similar manner as receiver 230*pa*.

In the exemplary design shown in FIG. 2, each transmitter 250 includes transmit circuits 252 and a power amplifier (PA) 254. For data transmission, data processor/controller 280 processes (e.g., encodes and modulates) data to be transmitted and provides an analog output signal to a selected transmitter. The description below assumes that transmitter 250*pa* is the selected transmitter. Within transmitter 250*pa*, transmit circuits 252*pa* amplify, filter, and upconvert the analog output signal from baseband to RF and provide a modulated RF signal. Transmit circuits 252*pa* may include amplifiers, filters, mixers, matching circuits, an oscillator, an LO generator, a PLL, etc. A PA 254*pa* receives and amplifies the modulated RF signal and provides a transmit RF signal having the proper output power level. The transmit RF signal is routed through antenna interface circuit 224 and transmitted via the primary antenna array 210. Each remaining transmitter 250 in transceivers 220 and 222 may operate in a similar manner as transmitter 250*pa*.

FIG. 2 shows an exemplary design of receiver 230 and transmitter 250. A receiver and a transmitter may also include other circuits not shown in FIG. 2, such as filters, matching circuits, etc. All or a portion of transceivers 220 and 222 may be implemented on one or more analog integrated circuits (ICs), RF ICs (RFICs), mixed-signal ICs, etc. For example, LNAs 240 and receive circuits 242 may be implemented on one module, which may be an RFIC, etc. The circuits in transceivers 220 and 222 may also be implemented in other manners. The RFIC may be included in a system in package (SiP) that also includes antennas, such as patch antennas as illustrated in FIG. 4.

Data processor/controller 280 may perform various functions for wireless device 110. For example, data processor/controller 280 may perform processing for data received via receivers 230 and data to be transmitted via transmitters 250. Data processor/controller 280 may control the operation of the various circuits within transceivers 220 and 222. A memory 282 may store program codes and data for data processor/controller 280. Data processor/controller 280 may be implemented on one or more application specific integrated circuits (ASICs) and/or other ICs.

Wireless device 110 may support multiple frequency band groups, multiple radio technologies, and/or multiple antennas. Wireless device 110 may include a number of LNAs to support reception via the multiple frequency band groups, multiple radio technologies, and/or multiple antennas.

Figure 3:
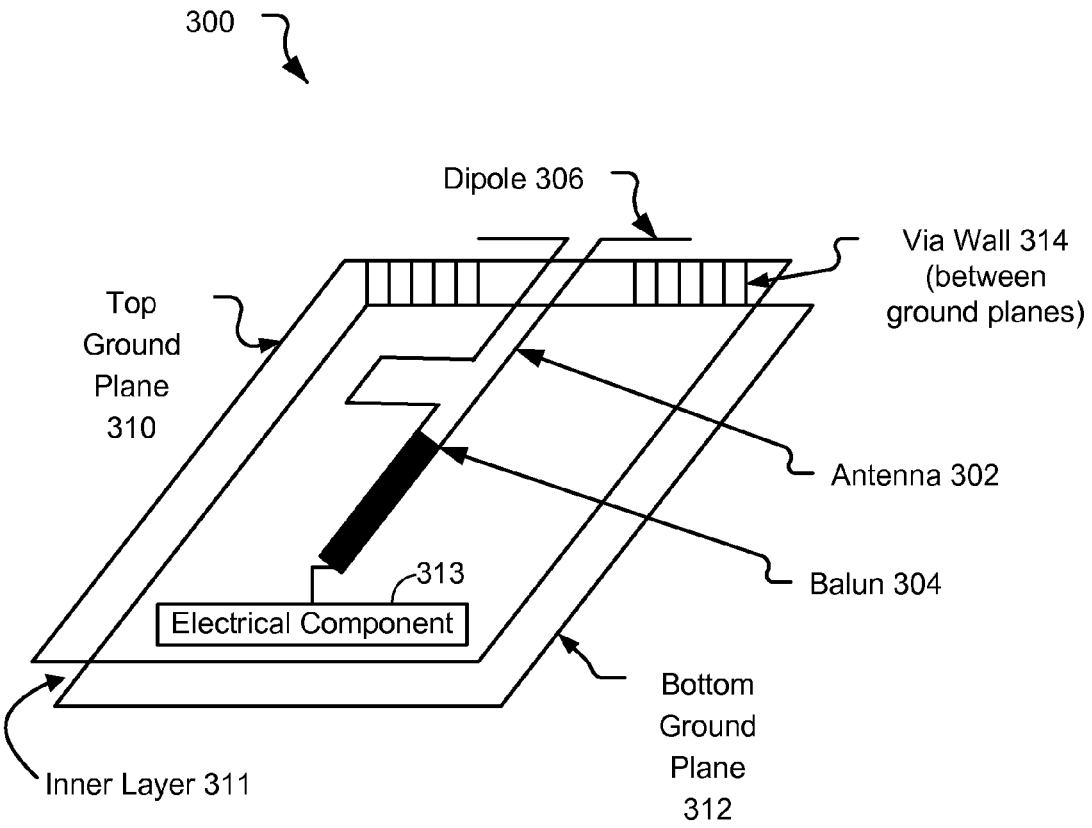
FIG. 3 shows a diagram of an exemplary embodiment of a quasi-yagi-type antenna that may be used by the wireless device of FIGS. 1-2.

FIG. 3 illustrates an antenna structure 300 that includes an antenna 302 configured as a quasi-yagi-type antenna and that includes a balun 304 between two ground planes. The antenna 302 may be one or many antennas of an antenna array, such as the antenna arrays 210-212 of the wireless device 110. As used herein, an "antenna structure" is defined as a structure that includes a balun and an antenna, an "antenna" is defined as any conductive element by which electromagnetic waves may be sent or received, and a "balun" is defined as any device that converts between a balanced signal (e.g., a differential signal) and an unbalanced signal (e.g., a single-ended signal).

The antenna 302 includes a dipole portion 306 and a wire portion that couples the dipole portion 306 to the balun 304. The balun 304 is configured to convert a received unbalanced signal to a balanced signal, such as by receiving an incoming signal and generating a phase adjusted signal that is provided to the dipole portion 306. For example, the balun 304 is illustrated as having an input to receive an incoming signal and includes two signal paths of different lengths to introduce a phase delay between output signals of the two signal paths. The output signals are provided to the dipole portion 306. The dipole portion 306 includes two dipole "arms." Each dipole arm is coupled to a respective signal path of the balun 304.

At least a portion of the antenna 302 (e.g., part of the wire portion between the dipole portion 306 and the balun 304) is placed in an inner layer 311 of a module that is between a first ground plane 310 (e.g., a top ground plane) and a second ground plane 312 (e.g., a bottom ground plane). A layer between ground planes may alternatively be referred to as an interlayer. The ground planes 310, 312 may be located at surfaces or interior layers of a substrate, such as a PC board. A plurality of vias may form a conductive "via wall" 314 that couples the two ground planes 310, 312 to each other and functions as a reflector of the dipole portion 306.

The antenna 302 may be fed with a stripline and a balun feed that is disposed in the inner layer 311 between the two ground planes 310, 312. For example, the balun 304 may be formed in a dielectric material of the inner layer 311 by using a photolithography and metal deposition process. To illustrate, the dielectric material may be deposited on the bottom ground plane 312, a photolithography and metal deposition process may be used to form a conductive wire pattern of the balun 304 above the bottom ground plane 312, and the top ground plane 310 may be formed above the balun 304. One or more electrical components 313 may also be coupled to the balun 304, such as an antenna feed, a waveguide, a transmission line, a connector, etc. For example, an antenna feed may include a tuner unit and/or an impedance matching component and may operate to adjust a received signal during transmission to or reception of signals from the antenna. A waveguide such as a coplanar waveguide may operate by providing a low-loss radio wave propagation medium. A transmission line such as a microstrip or stripline may operate by providing a propagation path to or from the antenna. A connector may operate by providing a connection to enable signal propagation between the balun and another component, such as an amplifier (e.g., the LNA 240*pa* or the PA 254*pa* of FIG. 2).

The quasi-yagi-type antenna, as illustrated in FIG. 3, radiates efficiently despite the two ground planes. For example, the quasi-yagi-type antenna may be included in a RF module, and the vias of the via wall 314 may be placed at locations to reflect certain radiation but also have an opening that permits signal radiation external to the RF module. Each of the ground planes 310, 312 may provide electromagnetic shielding to attenuate or eliminate interference between antennas on opposite sides of the ground plane 310 or 312. Designing an antenna that is encompassed in the inner layers of a module (as shown) can result in higher antenna density per area. For example, as described further with respect to FIGS. 4-5, an antenna density may be increased by "stacking" antennas in layers that are separated by ground planes to reduce interference between antennas in the stacks.

Figure 4:
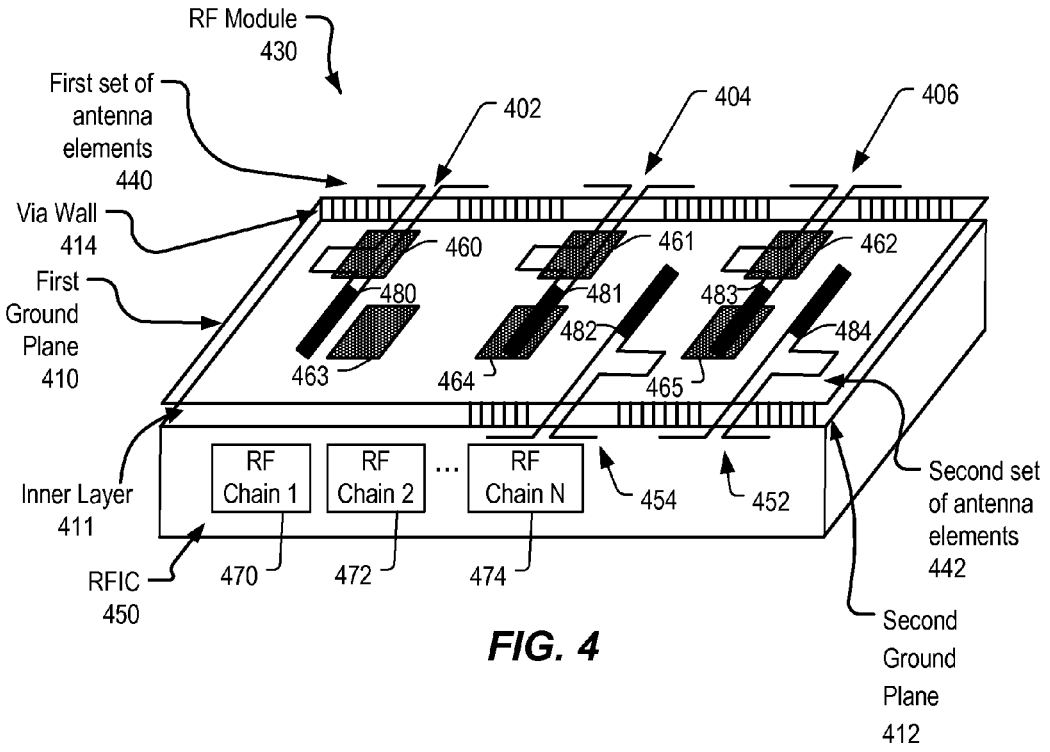
FIG. 4 illustrates a diagram of a radio frequency system that includes a radio frequency integrated circuit (RFIC) and multiple antennas including quasi-yagi-type antennas.

FIG. 4 illustrates an exemplary RF module 430 that includes multiple quasi-yagi-type antennas 402, 404, 406, 452, and 454. Each of the quasi-yagi-type antennas is within an inner layer 411 of the RF module 430 between a first ground plane 410 and a second ground plane 412. The first ground plane 410 and the second ground plane 412 may block radiation to reduce interference between the quasi-yagi-type antennas and components on the top and bottom surfaces of the RF module 430. For example, other antennas 460-465, such as patch antennas, may be located on the outer layer of a ground plane (e.g., on the first ground plane 410 so that the first ground plane 410 is between the patch antennas and baluns 480-484 of the quasi-yagi-type antennas).

The multiple quasi-yagi-type antenna elements have dipole portions that are disposed outside of the first and second ground planes 410, 412 (e.g., projecting out of an edge surface of the RF module 430), and the dipole portions are coupled to baluns that are disposed between the ground planes 410, 412. A via wall 414 may be positioned between the ground planes 410, 412 to function as a reflector for one or more of the dipoles.

Multiple sets of the quasi-yagi-type antennas may be formed proximate to different edges of the RF module 430. For example, a first set 440 of antenna elements may include the antennas 402, 404, and 406, and a second set 442 of antenna elements may include the antennas 452 and 454, each of which may be coupled to a respective balun 480-484, as shown. Although the RF module 430 is illustrated having two sets of quasi-yagi-type antennas along two edges of the RF module 430, in other implementations more than two sets of quasi-yagi-type antennas may be included. For example, four sets of quasi-yagi-type antennas may be included and each set may be proximate to a respective edge of the RF module 430 so that four edges of the RF module 430 include quasi-yagi-type antennas.

Figure 5:
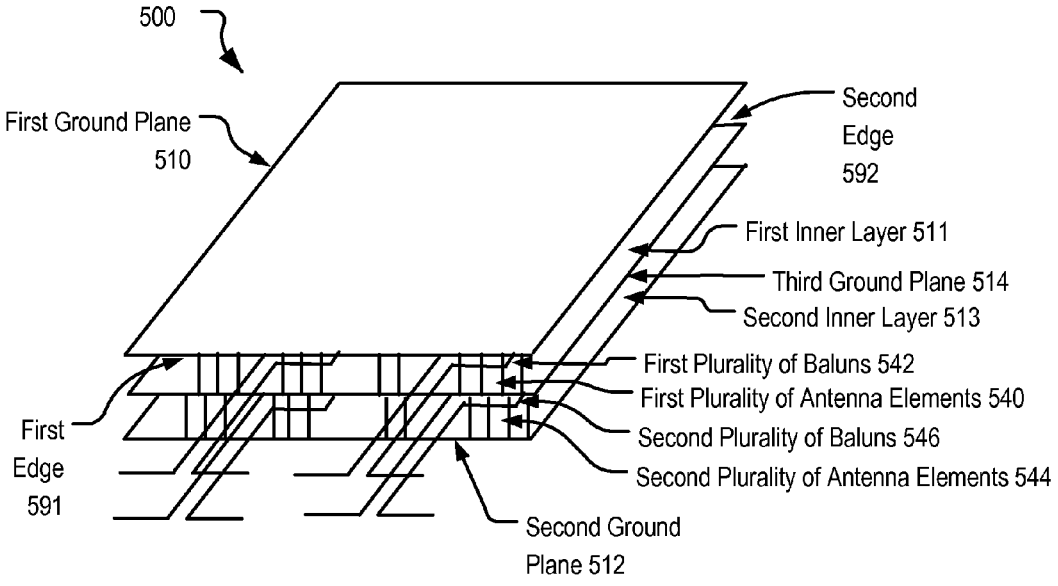
FIG. 5 shows a diagram of an exemplary embodiment of a module including multiple layers of quasi-yagi-type antennas.

Although the RF module 430 is illustrated as having a single layer of quasi-yagi-type antennas, additional layers of quasi-yagi-type antennas that are separated by ground planes may be included in the RF module, as described in further detail with respect to FIG. 5. In some embodiments, more than two layers of antennas may be included in a RF module.

The RF module 430 may be coupled to a radio frequency integrated circuit (RFIC) 450 that includes multiple RF chains 470-474 (e.g., mixers, amplifiers, etc.). For example, "N" RF chains 470-474 may be included in the RFIC 450, where N is any positive integer greater than one. At least one RF chain 470-474 within the RFIC 450 may be coupled to a first antenna element of the plurality of antenna elements (e.g., the quasi-yagi-type antennas 402, 404, 406, 452, and 454). The second ground plane 412 may be a bottom ground plane of the RF module 430. The second ground plane 412 may be disposed between the RFIC 450 and the baluns 480-484 and may reduce interference between antennas of the RF module 430 and components of the RFIC 450. Although the RFIC 450 is illustrated below the RF module 430 (e.g., a PC board) and is illustrated as thicker than the RF module 430, in other embodiments the RFIC 450 may have another position relative to the RF module 430 (e.g., adjacent to, above, etc.) and may have a different thickness relative to the RF module 430 (e.g., a substantially equal thickness as the RF module 430 or thinner than the RF module 430). The RF chains 470-474 may be coupled to individual antenna elements of the RF module 430.

The antennas of the RF module 430 (including the quasi-yagi-type antennas 402-406 and 452-454 and other types of antennas, such as the antennas 460-465) may be operated individually or as part of one or more arrays. When a group of antennas is operated as an antenna array, each antenna of the array may be coupled to a respective phase shifter within the RF module 430 for beam-forming. For example, the RF module 430 may include multiple phase shifters. Each antenna of the antenna array may be coupled to a respective phase shifter. For example, each of the patch antennas 460-465 may be coupled to a phase shifter and each of the quasi-yagi-type antennas 402, 404, 406, 452, and 454 may be coupled to a phase shifter. Each of the phase shifters may be configured to receive a signal to be transmitted by an antenna of the antenna array and to introduce a phase offset to the signal. Each phase-shifted signal generated by a phase shifter is provided to the antenna that is coupled to the phase shifter for transmission by the antenna. The resulting phase-shifted transmissions from the multiple antennas in the array may cause constructive and destructive interference in the transmitted signal to result in directional signal transmission (e.g., beam-forming).

Because multiple types of antennas such as the quasi-yagi-type antennas and the other antennas 460-465 (e.g., patch antennas) may be included in the RF module 430, a broader signal coverage may be provided as compared to using a single type of antenna. For example, one or more arrays of antennas may include multiple types of antennas that have different radiation patterns and that may provide different directional characteristics. A diversity of antenna positions, antenna orientations, and antenna types in an antenna array may provide improved overall coverage for the antenna array.

Although the RF module 430 is illustrated as having the antennas 460-465 on the first ground plane 410, in other embodiments, other devices, such as one or more surface mount technology (SMT) components, may be mounted on the first ground plane 410. For example, the SMT component may include one or more inductors, one or more capacitors, and/or an integrated circuit (IC) mounted to the surface of the RF module 430. Mounting an SMT component on the surface of the RF module 430 may enable a more compact PCB with reduced cost.

While three quasi-yagi-type antennas 402-406 are shown along one edge of the RF module 430, two quasi-yagi-type antennas 452-454 are shown along another edge of the RF module 430, and six other antennas 460-465 are shown on the first ground plane 410 in FIG. 4, any number of antennas may be placed on any of the edges and/or on any surface of the RF module 430, depending on space availability and design constraints. Although in some implementations, a number of the RF chains 470-474 equals the number of antennas of the RF module 430 and each RF chain is dedicated for use with a respective antenna, in other embodiments the number of RF chains is different from the number of antennas and a switching circuit (e.g., a high-speed crossbar) may be used to selectively couple or de-couple RF chains to antennas.

By including multiple quasi-yagi-type antennas between the ground planes 410, 412, the additional antennas 460-465 may also be included as part of the RF module 430 for enhanced antenna density. Antenna coverage and antenna array applications such as beam-forming may be enhanced by using a diversity of antenna orientations, antenna positions, and antenna types in a single RF module 430. Thus, FIG. 4 illustrates an RF module that provides enhanced antenna density and that may provide enhanced antenna coverage and enhanced antenna array applications.

FIG. 5 illustrates an exemplary embodiment of a module 500 that includes multiple ground planes and antennas between the ground planes. A first ground plane 510 and a second ground plane 512 may be top and bottom ground planes of the module 500, respectively. A third ground plane 514 is positioned between the top (510) and bottom (512) ground planes.

A first plurality of antenna elements 540 is coupled to a first plurality of baluns 542. Each balun of the first plurality of baluns 542 is disposed in a first inner layer 511 between the first ground plane 510 and the third ground plane 514. A first set of antenna elements of the first plurality of antenna elements 540 may be located proximate to a first edge 591 of the first inner layer 511. For example, the dipoles of the first set of antenna elements extend outward from the first edge 591 of the first inner layer 511 and are coupled to respective baluns that are also positioned near the first edge 591. A second set of antenna elements (not shown) of the first plurality of antenna elements 540 may be located proximate to a second edge 592 of the first inner layer 511. For example, the first set and the second set of antenna elements may correspond to the first set 440 and the second set 442 of antenna elements illustrated in FIG. 4. A second plurality of antenna elements 544 is coupled to a second plurality of baluns 546. The second plurality of baluns 546 is disposed within a second inner layer 513 between the third ground plane 514 and the second ground plane 512.

Although FIG. 5 illustrates two layers of quasi-yagi-type antennas separated by a single ground plane, in other embodiments more than two layers of antennas may be separated by multiple ground planes within a module. Alternatively, or in addition, one or more other types of antennas may be included, such as patch antennas on an upper surface of the first ground plane 510, in a similar manner as depicted in FIG. 4. The module 500 may be connected to an RFIC, such as the RFIC 450 of FIG. 4. For example, the module 500 may include vias or other conductive structures to enable signal routing through the ground planes 510, 512, 514 to antennas at different layers of the RF module 500. By positioning antennas in the inner layers between ground planes, several antennas may be stacked within the module 500 to provide increased antenna density as compared to using a single layer of antennas.

Figure 6:
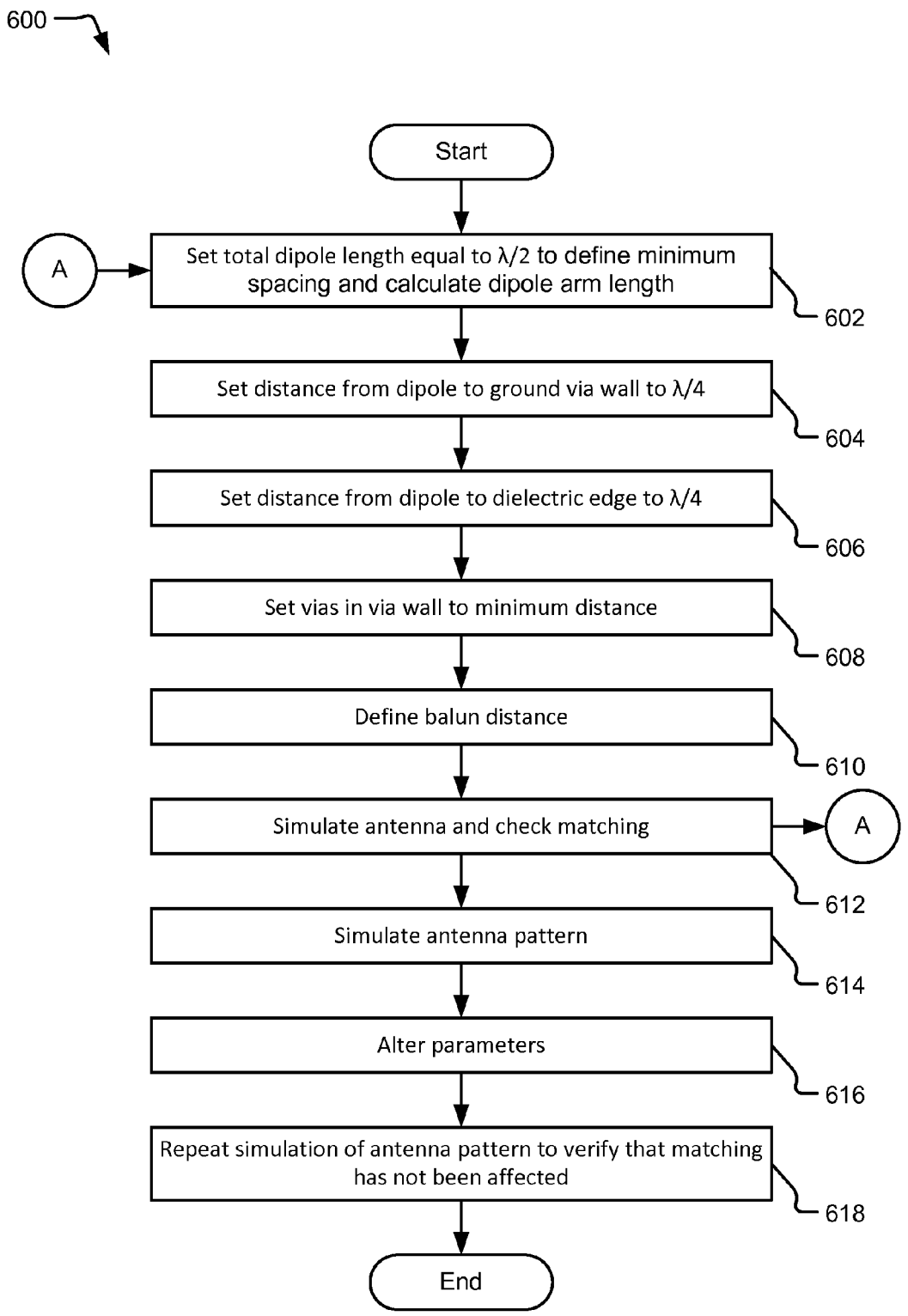
FIG. 6 illustrates a flowchart showing a method of forming a quasi-yagi-type antenna.

FIG. 6 illustrates an exemplary and non-limiting method for designing a quasi-yagi-type antenna, such as the antenna structure 300 of FIG. 3. A total dipole length (e.g., a tip-to-tip distance of the dipole portion 306 of FIG. 3) is set to a value that may equal a wavelength ($\lambda$) divided by 2 ($\lambda/2$), at 602. For example, the wavelength may correspond to a wavelength of a signal to be transmitted by the quasi-yagi-type antenna (e.g., a wavelength of approximately 5 millimeters (mm) for a 60 GHz signal). Based on the total dipole length, the minimum spacing between dipole arms is defined and dipole arm lengths are calculated. The distance from the dipole to the grounded via wall (e.g., the distance between the via wall 314 of FIG. 3 and the arms of dipole portion 306) is set to $\lambda/4$, at 604. The distance from the dipole to a dielectric edge is set to $\lambda/4$, at 606. A separation distance between vias in the via wall is set, at 608. For example, the separation distance may be set to a minimum allowed via separation that is defined by a fabrication technique.

A balun distance from the ground edge (e.g., a separation between the balun 304 and the upper surface of the bottom ground plane 312) is defined such that a quality of a resulting differential mode of signal propagation along the two signal paths to the dipole satisfies a differential signal quality threshold, at 610. For example, the balun 304 may be designed to generate a phase shift of substantially 180 degrees between signals "V1" and "V2" at the two arms of the dipole portion 306, with V1 and V2 having substantially equal amplitude. The quality of the differential signal may be defined by the ratio of the common mode (V1+V2)/2 to the differential mode (V1−V2)/2. An ideal differential signal has a zero common mode (i.e., V1=−V2). The separation between the balun and the ground plane may be set so that the quality of the differential signal matches or exceeds the differential signal quality threshold. The resulting antenna having the determined dipole arm lengths, spacing between dipole arms, distance between the via wall and the dipole arms, and separation between the ground plane and the balun is simulated and check matching is performed, at 612. If sufficient bandwidth is not achieved based on the simulation of the resulting antenna, one or more parameters described above may be adjusted, such as increasing the separation between the balun and the ground plane for wider matching, increasing or decreasing dipole length to reach a lower or higher center frequency, and/or adjusting other parameters, and then returning to 602 for continued processing.

Once sufficient bandwidth has been achieved based on simulation, an antenna pattern (i.e., signal strength of radiation from an antenna as a function of directional displacement from the antenna) is simulated, at 614. The parameters of ground size, distance to ground, distance to dielectric edge, and/or via distance may be changed to adjust or "tune" the antenna pattern, at 616. In some embodiments, one or more directors (e.g., yagi-type resonator elements) may be added to the antenna to modify the antenna radiation pattern for higher gain at the expense of increased antenna size. Antenna pattern simulation is repeated (after the adjustments at 616) to verify that matching is not affected, at 618. If matching has been affected, the pattern and matching may be co-tuned. For example, some antenna parameters, such as dipole arm length and distance from the ground plane, affect both the antenna pattern and the matching. Other antenna parameters primarily affect matching, such as the width of the transmission line feeding the dipole, or primarily affect pattern, such as distance between different dipole antennas. Because adjusting a parameter for pattern tuning may affect matching, one or more other parameters that primarily (or only) affect matching may also be adjusted to re-tune the matching. Similarly, adjusting a parameter for matching may affect the antenna pattern, and one or more other parameters that primarily (or only) affect the antenna pattern may also be adjusted to re-tune the pattern. Co-tuning the antenna pattern and the matching may therefore include adjusting multiple parameters.

Figure 7:
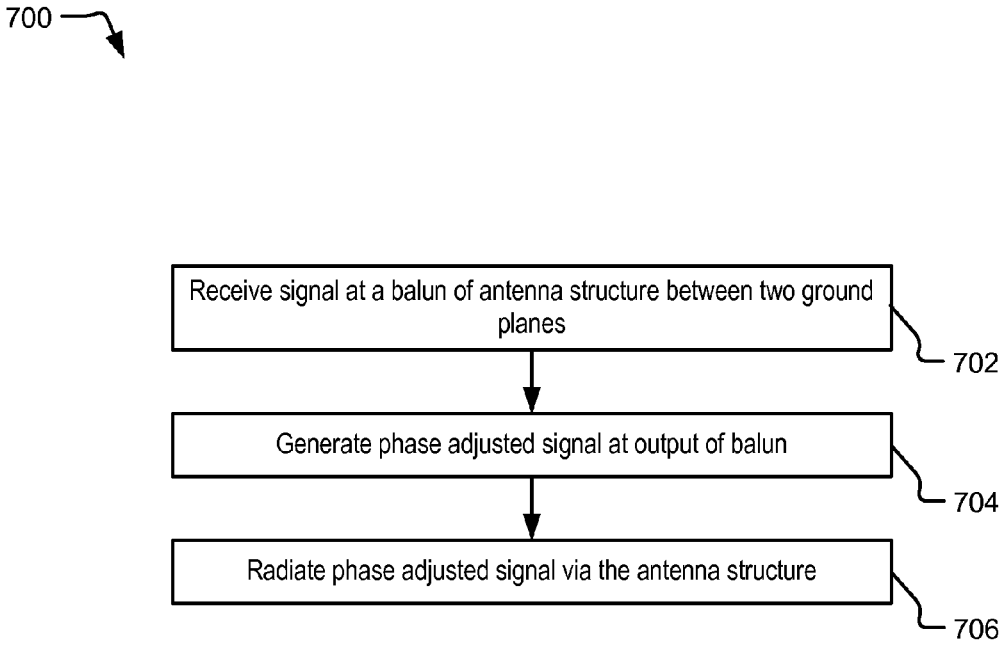
FIG. 7 illustrates a flowchart showing a method of communication using a quasi-yagi-type antenna.

FIG. 7 shows a flowchart of a method 700 of operation of a wireless device, such as transmission at the wireless device 110. The method 700 may include receiving a signal at a balun of an antenna structure that is between two ground planes, at 702. For example, the signal may be received from a radio frequency circuit, such as the RFIC 450 of FIG. 4. To illustrate, the signal may be a 60 GHz wireless signal. The signal may be received at the balun 304 of FIG. 3 (the balun 304 between the top ground plane 310 and the bottom ground plane 312).

The method 700 may also include generating a phase-adjusted signal at an output of the balun, at 704, and radiating the phase-adjusted signal using a quasi-yagi-type antenna, at 706. For example, the phase-adjusted signal may be generated at the balun 304 of FIG. 3. To illustrate, the balun 304 may split the received signal (e.g., the 60 GHz signal) via a first path and a second path, where the second path has a longer path length than the first path, to introduce a phase differential at the two signals output from the balun 304. The two signals output from the balun may be provided to respective dipole arms of the antenna dipole for wireless transmission of the signal. The antenna may be a quasi-yagi-type antenna and may include a reflector formed by a via wall connecting the ground planes, such as the via wall 314 of FIG. 3.

The method may also include radiating a second signal at a patch antenna. For example, one of the ground planes may be between the antenna structure and the patch antenna. For example, the first ground plane 410 may be between the antenna structure, such as the quasi-yagi-type antenna 402 and the balun that is coupled to the quasi-yagi-type antenna 402, and the other antenna 460 of FIG. 4. The second signal may correspond to a phase-shifted version of the first signal, such as when beam-forming is performed at an antenna array that includes the antenna structure (e.g., a quasi-yagi-type antenna coupled to a balun) and the patch antenna. Alternatively, the second signal may be independent of the first signal, such as when the antenna structure and the patch antenna transmit different data to different wireless networks (e.g., a 60 GHz broadband data network and a CDMA-type voice network).

During a receive operation, an oscillating electromagnetic field (e.g., a wireless signal) may induce a signal (e.g., an induced alternating current) in each dipole arm of the antenna. The signals may be phase-shifted relative to each other by the balun and combined (e.g., summed) to generate an output signal of the balun. The signal output by the balun may be provided to a receive chain for filtering and baseband conversion prior to processing by a data processor.

Positioning the balun between the pair of ground planes enables a high antenna density to be achieved. For example, the ground planes reduce interference at the balun that may otherwise result from signal transmission at antennas at other layers, such as from patch antennas at a surface layer of an RF module or from other edge antennas at other inner layers of the RF module.

In conjunction with the described embodiments, an apparatus includes means for radiating a signal. For example, the means for radiating the signal may include the dipole 306 of FIG. 3, one or more of the first plurality of antenna elements 540 or the second plurality of antenna elements 544 of FIG. 5, one or more other devices, circuits, or any combination thereof.

The apparatus includes means for generating a phase adjusted signal coupled to an input of the means for radiating. For example, the means for generating may include the balun 304 of FIG. 3, one or more of the first plurality of baluns 542 or the second plurality of baluns 544 of FIG. 5, one or more other devices, circuits, or any combination thereof.

The apparatus includes first means for grounding the means for generating and second means for grounding the means for generating. The means for generating is disposed between the first means for grounding and the second means for grounding. For example, the first means for grounding may include the top ground plane 310 or the bottom ground plane 312 of FIG. 3, the top ground plane 410 or the bottom ground plane 412 of FIG. 4, or the first ground plane 510, the second ground plane 512, or the third ground plane 514 of FIG. 5. The second means for grounding may include the top ground plane 310 or the bottom ground plane 312 of FIG. 3, the top ground plane 410 or the bottom ground plane 412 of FIG. 4, or the first ground plane 510, the second ground plane 512, or the third ground plane 514 of FIG. 5.

The apparatus may form a quasi-yagi-type antenna structure. Each of the means for grounding may attenuate or eliminate interference between antenna structures on opposite sides of the means for grounding (e.g., the ground plane 310 or 312 of FIG. 3). Designing an antenna structure that is at least partially encompassed in the inner layers of a module can result in higher antenna density. For example, as described with respect to FIGS. 4-5, an antenna density may be increased by "stacking" antennas in layers that are separated by ground planes.

Those of skill would further appreciate that the various illustrative logical blocks, configurations, modules, circuits, and algorithm steps described in connection with the exemplary embodiments disclosed herein may be implemented as electronic hardware, computer software executed by a processor, or combinations of both. Various illustrative components, blocks, configurations, modules, circuits, and steps have been described above generally in terms of their functionality. Whether such functionality is implemented as hardware or processor executable instructions depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the exemplary embodiments disclosed herein may be embodied directly in hardware, in a software module executed by a processor, or in a combination of the two. A software module may reside in random access memory (RAM), flash memory, read-only memory (ROM), programmable read-only memory (PROM), erasable programmable read-only memory (EPROM), electrically erasable programmable read-only memory (EEPROM), registers, hard disk, a removable disk, a compact disc read-only memory (CD-ROM), or any other form of non-transient storage medium known in the art. An exemplary storage medium is coupled to the processor such that the processor can read information from, and write information to, the storage medium. In the alternative, the storage medium may be integral to the processor. The processor and the storage medium may reside in an application-specific integrated circuit (ASIC). The ASIC may reside in a computing device or a user terminal. In the alternative, the processor and the storage medium may reside as discrete components in a computing device or user terminal.

The previous description of the disclosed embodiments is provided to enable a person skilled in the art to make or use the disclosed embodiments. Various modifications to these embodiments will be readily apparent to those skilled in the art, and the principles defined herein may be applied to other embodiments without departing from the scope of the disclosure. Thus, the present disclosure is not intended to be limited to the embodiments shown herein but is to be accorded the widest scope possible consistent with the principles and novel features as defined by the following claims.

What is claimed is:

1. An apparatus comprising:

a first ground plane;

a second ground plane;

an antenna including a dipole portion;

a balun coupled to the dipole portion of the antenna, the balun disposed between the first ground plane and the second ground plane, and at least a portion of the dipole portion of the antenna extended beyond the first ground plane and the second ground plane; and a plurality of vias that form a reflector between the dipole portion and the balun.

2. The apparatus of claim 1, wherein at least a portion of the antenna is coupled to the balun and is disposed between the first ground plane and the second ground plane.

3. The apparatus of claim 1, further comprising an inner layer between the first ground plane and the second ground plane, the balun disposed in the inner layer.

4. The apparatus of claim 1, the first ground plane coupled to the second ground plane by the plurality of vias.

5. The apparatus of claim 4, the reflector and the dipole portion configured according to a Yagi-type antenna configuration.

6. The apparatus of claim 1, further comprising a surface mount technology (SMT) component mounted on a first surface of the first ground plane, wherein the balun is disposed between a second surface of the first ground plane and the second ground plane, and wherein the second surface is opposite the first surface.

7. The apparatus of claim 1, further comprising an electrical component coupled to the balun, wherein the electrical component comprises a transmission line, an antenna feed, a waveguide, or a combination thereof.

8. The apparatus of claim 1, further comprising a patch antenna coupled to the first ground plane.

9. The apparatus of claim 1, further comprising a patch antenna, wherein the first ground plane is between the patch antenna and the balun.

10. The apparatus of claim 1, the first ground plane coupled to the second ground plane by the plurality of vias, wherein the reflector formed by the plurality of vias includes a grounded via wall reflector and wherein a distance from the dipole portion to the grounded via wall reflector is approximately a quarter-wavelength of a signal to be transmitted.

11. The apparatus of claim 1, further comprising a plurality of antenna elements coupled to a plurality of baluns disposed between the first ground plane and the second ground plane.

12. The apparatus of claim 11, wherein the plurality of antenna elements includes a first set of antenna elements located proximate to a first edge of an inner layer between the first ground plane and the second ground plane and a second set of antenna elements located proximate to a second edge of the inner layer.

13. The apparatus of claim 11, further comprising a third ground plane and a second inner layer between the second ground plane and the third ground plane, and further comprising a second plurality of antenna elements coupled to a second plurality of baluns disposed within the second inner layer.

14. The apparatus of claim 11, further comprising a radio frequency integrated circuit (RFIC) coupled to the first ground plane, the first ground plane between the RFIC and the plurality of baluns, wherein at least one RF chain within the RFIC is coupled to a first antenna element of the plurality of antenna elements.

15. The apparatus of claim 14, wherein multiple RF chains in the RFIC are coupled to multiple antenna elements.

16. A method of communication comprising:

receiving a signal at a balun of an antenna structure, the balun between two ground planes and coupled to a dipole portion of an antenna of the antenna structure, wherein at least a portion of the dipole portion of the antenna is extended beyond the two ground planes and beyond a grounded reflective via wall between the dipole portion and the balun;

generating a phase adjusted signal at an output of the balun; and radiating the phase adjusted signal via the dipole portion of the antenna.

17. The method of claim 16, further comprising radiating a second signal at a patch antenna, wherein the second signal is independent of the phase adjusted signal, and wherein one of the two ground planes is between the antenna structure and the patch antenna.

18. An apparatus comprising:

means for radiating a signal;

means for generating a phase adjusted signal coupled to the means for radiating;

first means for grounding the means for generating;

second means for grounding the means for generating; and a plurality of means for reflecting coupled to the first means for grounding and to the second means for grounding, wherein the means for generating is disposed between the first means for grounding and the second means for grounding, and wherein at least a portion of the means for radiating is extended beyond the first means for grounding and the second means for grounding and beyond the plurality of means for reflecting.

19. The apparatus of claim 18, the means for radiating and the plurality of means for reflecting forming a Yagi antenna.

20. The apparatus of claim 19, wherein the plurality of means for reflecting form a via wall coupled to the first means for grounding and to the second means for grounding.

* * * * *